US010725416B2

(12) United States Patent
Funakawa

(10) Patent No.: US 10,725,416 B2
(45) Date of Patent: Jul. 28, 2020

(54) IMAGE FORMING APPARATUS WITH STATUS NOTIFIER

(71) Applicant: KONICA MINOLTA, INC., Chiyoda-ku, Tokyo (JP)

(72) Inventor: Hisataka Funakawa, Hachioji (JP)

(73) Assignee: Konica Minolta, Inc., Chiyoda-ku, Tokyo (JP)

( * ) Notice: Subject to any disclaimer, the term of this patent is extended or adjusted under 35 U.S.C. 154(b) by 0 days.

(21) Appl. No.: 16/281,196

(22) Filed: Feb. 21, 2019

(65) Prior Publication Data

US 2019/0294098 A1 Sep. 26, 2019

(30) Foreign Application Priority Data

Mar. 23, 2018 (JP) ..... 2018-055781

(51) Int. Cl.
*G03G 15/00* (2006.01)

(52) U.S. Cl.
CPC ..... *G03G 15/5062* (2013.01); *G03G 15/5016* (2013.01)

(58) Field of Classification Search
None
See application file for complete search history.

(56) References Cited

U.S. PATENT DOCUMENTS

| | | | | |
|---|---|---|---|---|
| 4,866,486 | A * | 9/1989 | Higashio | G03G 15/50 399/184 |
| 7,942,413 | B2 * | 5/2011 | Eguchi | B65H 43/06 271/278 |
| 9,944,489 | B2 * | 4/2018 | Arikawa | B65H 31/22 |
| 2005/0017426 | A1 * | 1/2005 | Hirata | B65H 37/00 270/58.08 |
| 2017/0088387 | A1 * | 3/2017 | Arikawa | B65H 43/08 |

FOREIGN PATENT DOCUMENTS

| | | | |
|---|---|---|---|
| JP | H08339107 | A | 12/1996 |
| JP | 10151988 | A * | 6/1998 |

* cited by examiner

*Primary Examiner* — Victor Verbitsky
(74) *Attorney, Agent, or Firm* — Buchanan Ingersoll & Rooney PC

(57) ABSTRACT

An image forming apparatus, includes: an image former that forms an image on a recording medium; an ejector to which a recording medium is ejected; a notifier that visually notifies a predetermined operation state of the image forming apparatus using a light source; and a hardware processor that controls image forming operation of the image former, ejecting operation of the ejector, and notifying operation of the notifier, wherein the hardware processor executes, using the notifier that serves multiple functions, a first notification function of notifying that the image forming operation is in progress at a time when the image forming operation is executed, and a second notification function of notifying that the image formation is complete and the recording medium having been subject to the image formation is ejected.

17 Claims, 10 Drawing Sheets

OPTICAL AXIS IS DIRECTED TO RIGHT

OPTICAL AXIS IS DIRECTED TO LEFT

ILLUMINATION RANGE IS INCREASED IN LONGITUDINAL DIRECTION

ILLUMINATION RANGE IS INCREASED IN LATERAL DIRECTION

IMAGE FORMING APPARATUS WITH STATUS NOTIFIER

The entire disclosure of Japanese patent Application No. 2018-055781, filed on Mar. 23, 2018, is incorporated herein by reference in its entirety.

BACKGROUND

Technological Field

The present invention relates to an image forming apparatus that forms an image on a recording medium to discharge it to an ejector.

Description of the Related Art

In an image forming apparatus such as a copier, a printer, a scanner and a multifunction peripheral in which those functions are combined, a job instruction, such as printing using a network, may be provided from a location away from the image forming apparatus in some cases. In this case, there has been known the image forming apparatus provided with an indicator lamp that notifies an operation state of the image forming apparatus so that it can be easily visually recognized whether the executed job instruction is properly received by the image forming apparatus to execute printing operation.

The image forming apparatus provided with the indicator lamp can notify a user that an image is being formed by turning on the indicator lamp during image formation.

In addition, along with the increase in size of an operation panel in recent years, a sheet ejection destination is shadowed by the operation panel in a sheet ejector for ejecting a paper sheet on which an image is formed, whereby the ejected sheet is difficult to confirm. For that reason an apparatus having a function of illuminating the sheet ejector has also increased.

For example, in JP H08-339107 A, an illumination lamp is installed above a sheet ejector surrounded by a device housing except for the front surface, which is automatically turned on when a sheet is ejected to the sheet ejector and is turned off when a predetermined time has elapsed. Accordingly, the ejected sheet can be easily confirmed.

The illumination of the indicator lamp and the sleet ejector is performed by notifiers disposed independently. Accordingly, a plurality of notifiers needs to be provided to confirm operation thereof so that a light source, a control circuit, and the like corresponding to each notifier are required, which leads to an increase in cost.

SUMMARY

The present invention has been conceived in view of the problem described above, and an object of the present invention is to provide an image forming apparatus capable of achieving a function of illuminating an ejector of a recording medium and a function of notifying that an image is being formed using a common notifier.

To achieve the abovementioned object, according to an aspect of the present invention, an image forming apparatus reflecting one aspect of the present invention comprises: an image former that forms an image on a recording medium an ejector to which a recording medium is ejected; a notifier that visually notifies a predetermined operation state of the image forming apparatus using a light source; and a hardware processor that controls image forming operation of the image former, ejecting operation of the ejector, and notifying operation of the notifier, wherein the hardware processor executes, using the notifier that serves multiple functions, a first notification function of notifying that the image forming operation is in progress at a time when the image forming operation is executed, and a second notification function of notifying that the image formation is complete and the recording medium having been subject to the image formation is ejected.

BRIEF DESCRIPTION OF THE DRAWINGS

The advantages and features provided by one or more embodiments of the invention will become more fully understood from the detailed description given hereinbelow and the appended drawings which are given by way of illustration only, and thus are not intended as a definition of the limits of the present invention.

DETAILED DESCRIPTION OF EMBODIMENTS

Figure 1:
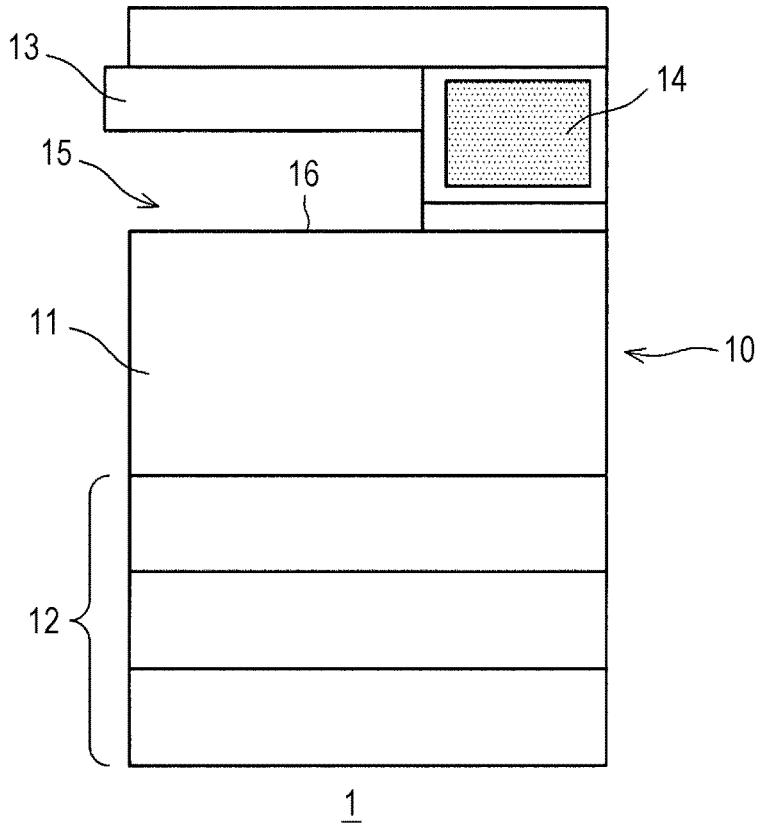
FIG. 1 is a diagram illustrating a configuration of an image forming apparatus according to one embodiment of the present invention.

Hereinafter, one or more embodiments of the present invention will be described with reference to the drawings. However, the scope of the invention is not limited to the disclosed embodiments.

Hereinafter, an image forming apparatus according to one embodiment of the present invention will be described with reference to FIG. 1.

An image forming apparatus 1 includes a document reader 13 on the upper portion of an apparatus body 2. The document reader 13 can optically read a document set on a platen glass or a document set on an automatic document feeder (ADF) to obtain image data.

A plurality of stages of a sheet cassette 11 is provided in the lower portion of the apparatus body 2 of the image forming apparatus 1. The sheet cassette 11 stores paper sheets. In this embodiment the paper sheet corresponds to a recording medium according to the present invention. Note that the material of the recording medium is not limited to paper according to the present invention, and may be a material such as cloth and plastic. The paper sheet stored in the sheet cassette 11 can be supplied to an image former 12.

The image former 12 for forming an image on a paper sheet is provided over the sheet cassette 11. The image former 12 forms an image on the paper sheet supplied from the sheet cassette 11 using a method of electrophotography. Note that the image former 12 may perform color printing, or may perform monochrome printing using black, for example. Further, the image former 12 may form an image using a method other than the electrophotography.

A sheet ejector 15 is provided in a space between the document reader 13 and the image former 12. The upper side of the sheet ejector 15 is covered by the side of the document reader 13, and the sheet ejector 15 is located in the apparatus body 2 of the image forming apparatus 1. The paper sheet on which the image is formed by the image former 12 is ejected to the sheet ejector 15, and the paper sleet is successively placed on a sheet ejection undersurface 16 of the sheet ejector 15. The sheet ejection undersurface 16 is substantially parallel to the installation surface of the apparatus, and the paper sheet is ejected in the horizontal direction. The sheet ejector 15 corresponds to the ejector according to the present invention.

An operation part 14 for operating the image forming apparatus 1 is provided on the lateral front side of the sheet ejector 15. The operation part 14 is disposed to cover a part of the sheet ejector 15.

The operation part 14 may include a light-emitting diode (LED) provided with a touch panel, which may display information and receive operation input. Further, an inclination angle of the operation part 14 can be adjusted to improve the operability, and the operation part 14 is attached to a fixed stay fixed to an apparatus body 10 to be rotatable in the vertical direction within an adjustment range.

Note that, an operation part and a display are integrated in the operation part 14 according to the present embodiment, the operation part may include a group of operation keys, a mouse, and the like, and the operation part and the display may be separately provided.

Besides, an illuminator 20 for emitting light toward the back side is provided on a fixed stay (not illustrated) on the back side of the operation part 14. The illuminator 20 is disposed at such a position that can illuminate the undersurface of the sheet ejector 15 and the exterior face of the apparatus body 10 (front surface of the document reader 13). The illuminator 20 will be described later.

Figure 2:
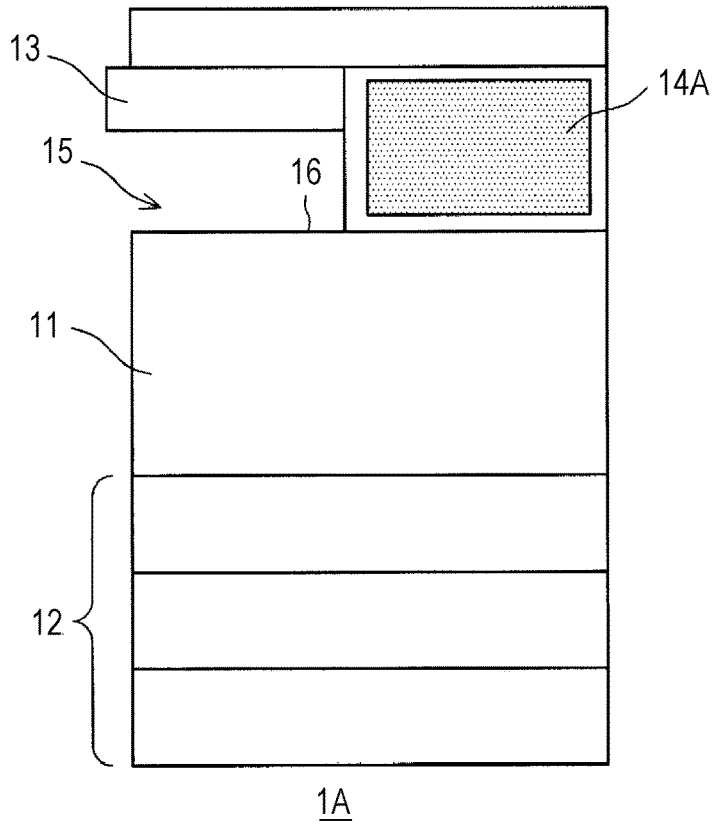
FIG. 2 is a diagram illustrating a configuration of an image forming apparatus provided with an operation part having a large size according to one embodiment of the present invention.

Next, a configuration of an image forming apparatus 1A provided with a relatively large operation panel is illustrated in FIG. 2. The configurations same as those of the image forming apparatus 1 in FIG. 1 will be denoted by the same reference signs, and descriptions thereof will be omitted.

In order to improve the operability and viewability, the image forming apparatus 1A includes an operation part 14A having a relatively large size compared with the image forming apparatus 1.

However, a relatively large part of the sheet ejector 15 is concealed by the operation part 14A as the operation part is enlarged, whereby the paper sheet ejected to the sheet ejector 15 may be difficult to confirm.

Note that the image forming apparatus according to the present invention is not limited to the image forming apparatuses having the configurations illustrated in FIGS. 1 and 2, and may include another device. For example, a post-processing device for performing post-processing of the paper sheet may be connected to the sheet ejector 15.

Figure 3:
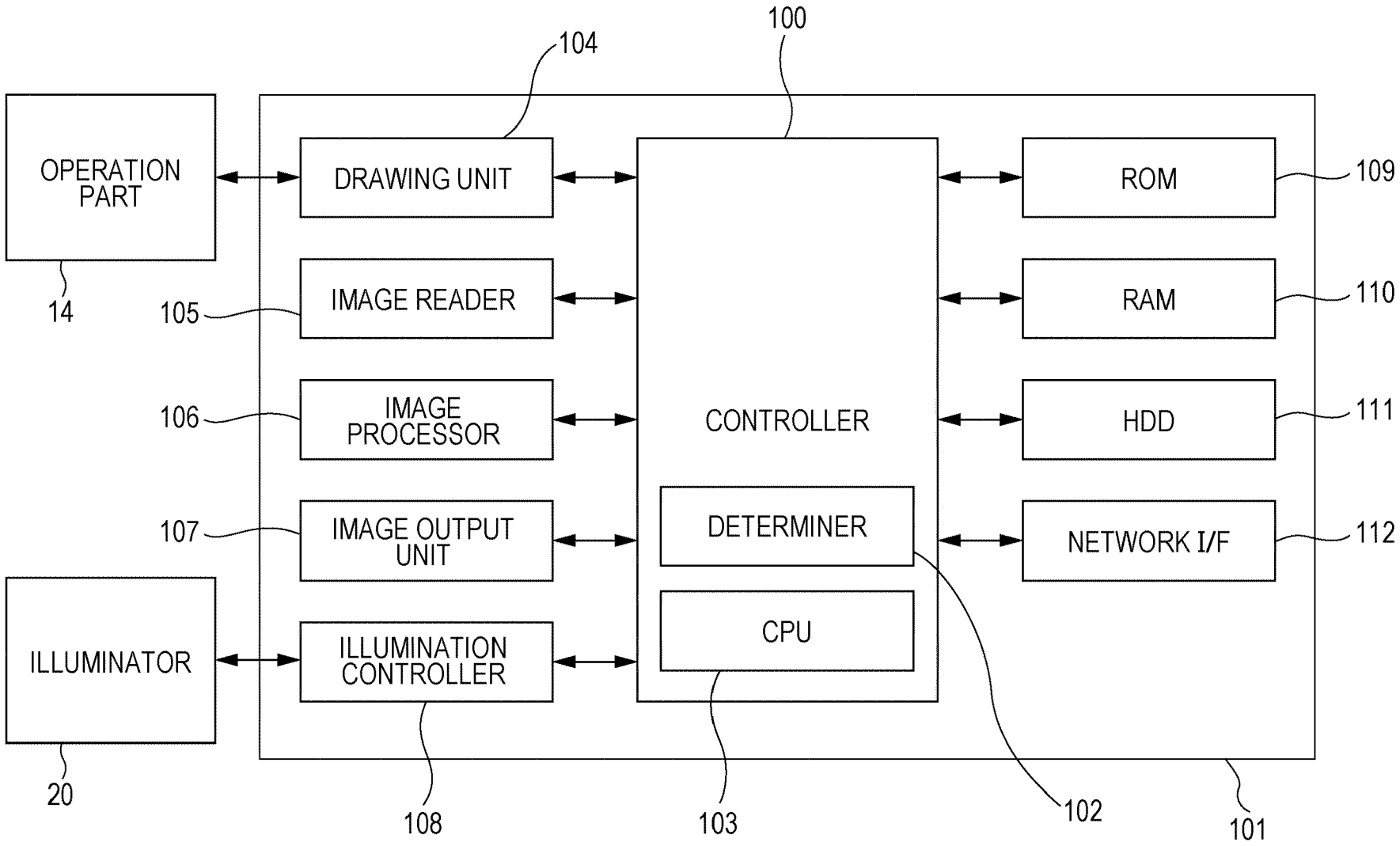
FIG. 3 is a control block diagram of an image forming apparatus according to one embodiment of the present invention.

Next, a control block of the image forming apparatus 1 will be described with reference to FIG. 3.

The image forming apparatus 1 mainly includes an overall control block 101, the operation part 14, and the illuminator 20.

The overall control block 101 includes a controller 100. The controller 100 controls the entire image forming apparatus 1, and also controls the illuminator 20 to be described later. The controller 100 mainly includes a central processing unit (CPU) 103, and a program executed in the CPU 103. The controller 100 includes a determiner 102 to be operated by the program being executed. The determiner 102 can determine whether the post-processing device is connected to the image forming apparatus.

The overall control block 101 further includes a drawing unit 104, an image reader 105, an image processor 106, an image output unit 107, an illumination controller 108, a read-only memory (ROM) 109, a random access memory (RAM) 110, a hard disk drive (HDD) 111, and a network interface (IF) 112.

The controller 100 is connected to the drawing unit 104 in a controllable manner, and the operation part 14 is connected to the drawing unit 104. The drawing unit 104 generates an image to be displayed on the operation part 14, and the operation part 14 displays the image generated by the drawing unit 104 on the screen.

The controller 100 is connected to the image reader 105 in a controllable manner. The image reader 105 processes the image read by an optical sensor such as a charge-coupled device (CCD) sensor and a complementary metal-oxide semiconductor (CMOS) sensor. The controller 100 can obtain the processed image data.

The controller 100 is connected to the image processor 106 in a controllable manner. The image processor 106 performs processing such as correction and processing on the read image and the image to be output. For example, shading processing or analog/digital (A/D) conversion processing on the read image, density correction of the image to be output, and the like can be performed.

The controller 100 is connected to the image output unit 107 in a controllable manner. The image output unit 107 generates an output image, and outputs the image using the image former 12.

The controller 100 is connected to the illumination controller 108 in a controllable manner, and the illuminator 20 is connected to the illumination controller 108. The illumination controller 108 can control lighting of the illuminator 20 on the basis of an instruction from the controller 100. For example, a light source can be blinked during image formation, switched from the blinking state to the lighting state after the image formation is complete, and turned off after a lapse of a predetermined time.

The illuminator 20 includes a light source such as an LED, and an optical system such as a lens. Note that the illuminator 20 may include a plurality of light sources, or may include only one light source.

The illumination controller 108 and the illuminator 20 constitute a part of or all of a notifier according to the present invention.

Further, the ROM 109, the RAM 110, and the HDD 111 (magnetic hard drive) are connected to the controller 100. The ROM 109 is used for storing data, and stores a program, a parameter, and the like to be executed by the controller 100. The RAM 110 is used for primary storage of data, and is used as a work area at the time of executing a program. The HDD 111 can store job image data, setting data, a program, and the like.

The ROM 109 stores setting data such as machine setting information, a process control parameter, and the like. Furthermore, the ROM 109 stores a program and a parameter for controlling the lighting and the illumination range of the illuminator 20, information associated with the illumination position corresponding to the sheet size and the orientation, a sheet ejection control parameter, information associated with the sheet ejection position at the time of connecting the post-processing device, and the like.

The controller 100 is connected to the network IF 112 in a controllable manner. A network typified by a local area network (LAN) can be connected to the network IF 112, and the controller 100 can exchange data with another device connected to the network via the network IF 112. For example, a job can be received from another device connected to the network to form an image using the image forming apparatus 1 on the basis of the received job data.

In the image forming apparatus provided with the sheet ejector in the apparatus body for space saving, the ejected paper sheet may be difficult to visually recognize. For that reason, it has been conventionally proposed to provide an illumination lamp in the sheet ejector to facilitate viewing of the ejected paper.

Moreover, in the field of the image forming apparatus, there has been known an apparatus in which an indicator lamp for notifying a state of the image forming apparatus is provided to visually notify whether the image forming apparatus has received a job and printing operation is being executed in a case where the image forming apparatus is used as a network printer.

Figure 12:
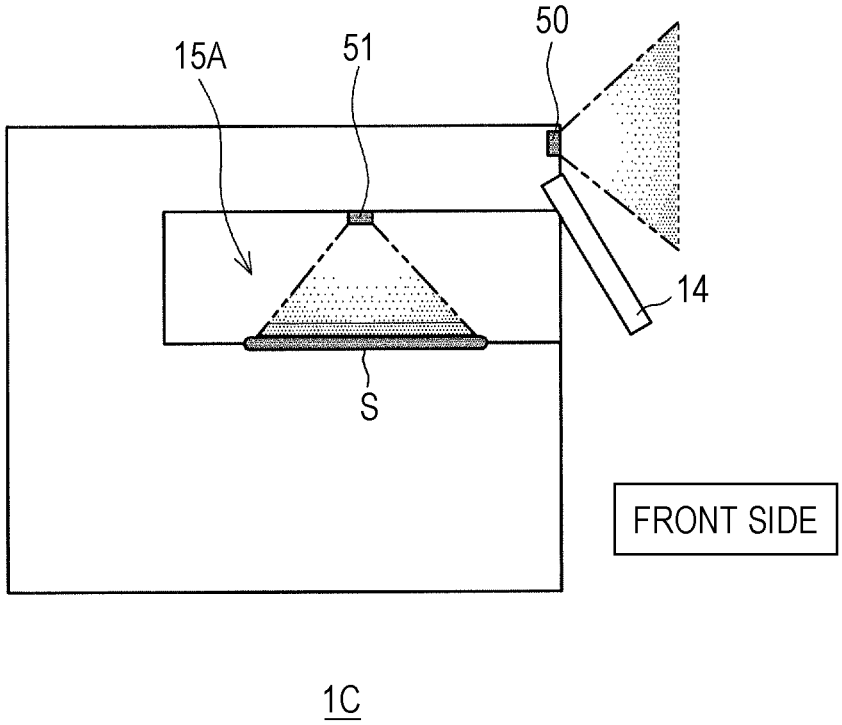
FIG. 12 is a diagram illustrating a configuration of a notifier in a conventional image forming apparatus.

FIG. 12 illustrates an exemplary configuration of the image forming apparatus using a conventional illumination lamp and the indicator lamp.

In the conventional configuration an indicator lamp 50 for notifying the printing operation is disposed on the front side of an image forming apparatus 1C so that a lighting state can be recognized even from a position away from the image forming apparatus 1C. In a sheet ejector ISA, in addition to the indicator lamp 50, an illumination lamp 51 for emitting light downward from the top of the sheet ejector 15A is provided to illuminate the paper sheet ejected to the sheet ejector.

Both of the indicator lamp 50 and the illumination lamp 51 function as notification related to the printing operation, and it is easier to understand when the notification is made in association with each other. However, the paper ejection is performed in the horizontal direction with respect to the installation surface of the apparatus according to the structure of the image former of the general image forming apparatus, whereby the light source is also disposed to illuminate the horizontal direction with respect to the installation surface of the apparatus. Meanwhile, the indicator lamp for notifying the printing operation is disposed in the direction perpendicular to the installation surface of the apparatus so that a person away from the image forming apparatus can be notified of the status. Accordingly, as illustrated in FIG. 12, the above-described two light sources and lamps are disposed independently at positions away from each other, and do not have a common configuration, resulting in an increase in cost.

In the present embodiment, the illuminator including the light source is disposed in the vicinity of the back surface of the panel of the operation part 14, whereby the sheet ejection undersurface 16 parallel to the installation surface of the apparatus and the exterior face of the apparatus body disposed in the direction perpendicular to the installation surface of the apparatus are simultaneously illuminated. The light emitted to the exterior face is reflected by the reflective surface of the exterior face and can be visually recognized even from a position away from the machine, whereby the ejected paper sheet can be illuminated by one light source while notification can be made to a position away from the apparatus.

As a result, one light source can have the function of the indicator lamp and the illumination lamp, whereby the light source having been conventionally disposed separately can be disposed in one location.

The arrangement of the illuminator 20 will be described with reference to FIG. 4.

Figure 4:
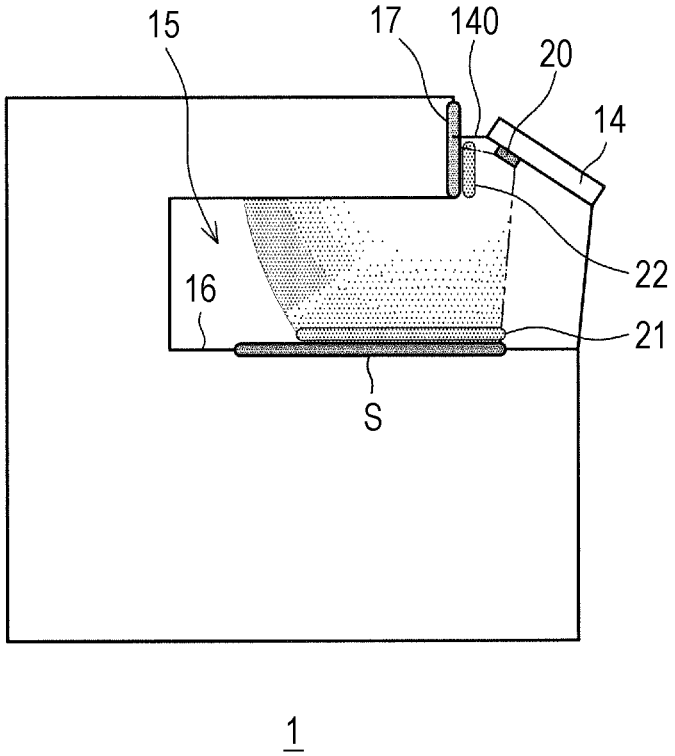
FIG. 4 is a diagram illustrating an arrangement of an illuminator in an image forming apparatus according to one embodiment of the present invention.

FIG. 4 is a diagram illustrating a side surface of the sheet ejector 15 of the image forming apparatus 1.

The illuminator 20 including the light source is disposed on the back surface side of the operation part 14. The illuminator 20 can illuminate both of an exterior face 17 perpendicular to the installation surface of the apparatus and the sheet ejection undersurface 16 on which an ejected paper sheet S is placed. In an illumination area 22 of the exterior face 17, the surface of the exterior face 17 is made to be the reflective surface. This reflective surface is a part of the configuration of the notifier.

The light emitted from the illuminator 20 to the illumination area 22 of the exterior face 17 is reflected by the reflective surface, whereby the lighting of the light source can be visually recognized even from a position away from the image forming apparatus 1. Note that a material having high reflectance or the like may be disposed on the reflective surface.

Further, in the sheet ejector 15, an illumination area 21 on the ejected paper sheet on the sheet ejection undersurface 16 is illuminated by the illuminator 20, whereby the ejected paper sheet can be easily visually recognized.

Note that, although the illuminator 20 is disposed on the back side of the operation part 14 in FIG. 4, the arrangement position of the illuminator 20 is not particularly limited in the present invention, and it may be any position as long as both of the exterior face of the apparatus and the ejected paper sheet can be illuminated.

In addition, in a case where an angle of the panel of the operation part 14 can be changed or a case where the operation part 14 is made movable, the illumination position is shifted as the operation part moves with the illuminator 20 being provided on the back side of the operation part 14, whereby the illuminator 20 is preferably disposed at the position not affected by the movement of the operation part 14. For example, in a case where the operation part 14 is supported by the apparatus body 2 using a fixed stay 140, the illuminator 20 can be attached to the fixed stay 140.

Furthermore, the manner of illumination using the light source may be changed between the time at which the image is formed and the time after the image formation is complete. Changing the manner of illumination of the light source is an example of the illumination change. For example, in a case where the image forming apparatus 1 has received a job and the printing operation is being executed, the light source is blinked as a first notification function, and when the image formation is complete thereafter, the light source is switched to a lit state as a second notification function, thereby illuminating the ejected paper sheet for easy recognition. This makes it easier to recognize which operation state of the image forming apparatus is being notified.

Figure 5:
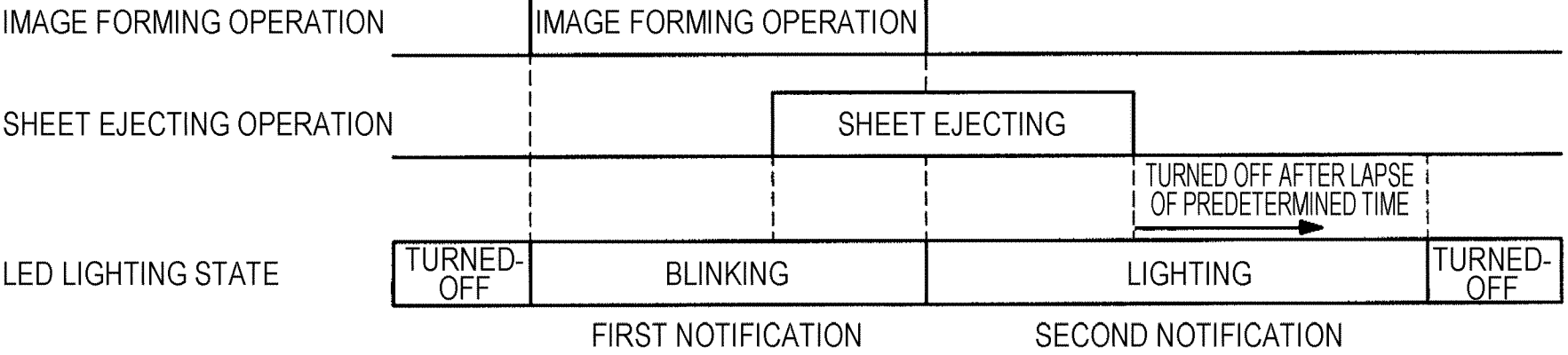
FIG. 5 is a time chart illustrating illumination operation of a light source in an image forming apparatus according to one embodiment of the present invention.

An example of the lighting state change of the light source is illustrated in FIG. 5.

When neither the image forming operation nor the sheet ejecting operation is performed, the LED (light source) of the illuminator is turned off. When the image forming operation starts, the LED (light source) is controlled to blink, thereby notifying that the image is being formed. Although ejection of the paper sheet starts thereafter, the light source continues to blink while the image forming operation continues, thereby indicating that the image is being formed.

After the image formation is complete, the blinking of the LED (light source) is switched to lighting, thereby notifying that the image formation is complete and the paper sheet is ejected. The light source is kept in the lighting state for a predetermined time after the paper sheet ejection, which makes it easy to recognize that the paper sheet has been ejected.

Figure 6:
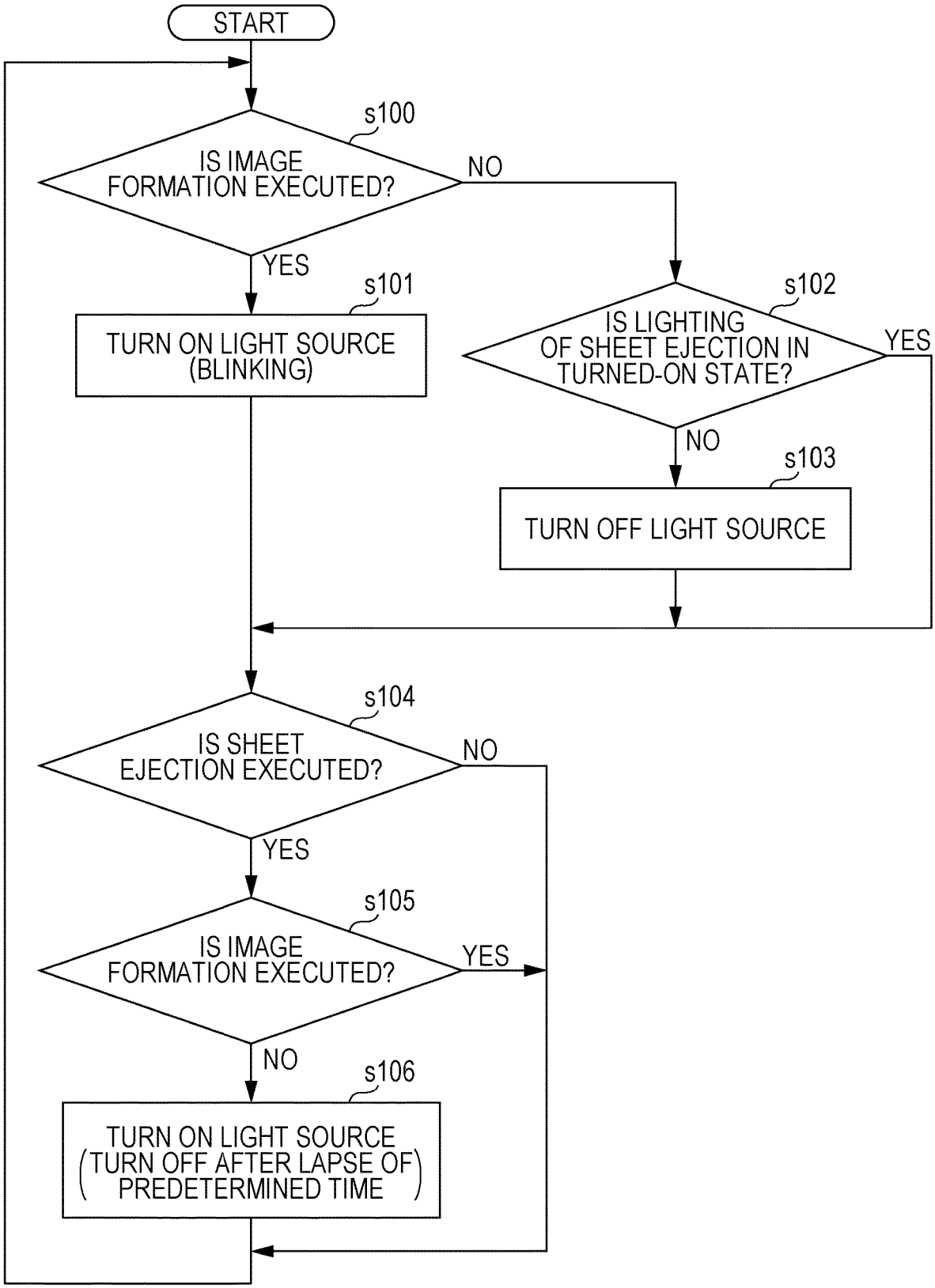
FIG. 6 is a flowchart illustrating a illumination procedure of a light source in an image forming apparatus according to one embodiment of the present invention.

The procedure of the light source lighting control will be described with reference to the flowchart of FIG. 6. The following control is executed by the control of the controller 100.

First, it is determined whether the image formation is being executed (step s100). When the image formation is being executed (Yes in step s100), the light source is turned on in a blinking state (step s101).

Thereafter, it is determined whether the ejection of the paper sheet is being executed (step s104). When the ejection of the paper sheet is not being executed (No in step s104), the process proceeds to step s100 to determine whether the image formation is being executed.

When the ejection of the paper sheet is being executed (Yes in step s104), it is determined whether the image formation is being executed (step s105).

When the image formation is not being executed (No in step s105), the light source is turned on with a setting of being turned off after a predetermined time (step s106), and then the process proceeds to step s100 to determine whether the image formation is being executed.

When the image formation is being executed (Yes in step s105), the process returns to step s100, and the subsequent steps are repeated.

When the image formation is not being executed in step s100 (No in step s100), it is determined whether the lighting of the paper sheet ejection is in the turned-on state (step s102). When the lighting of the paper sheet ejection is not in the turned-on state (No in step s102), the light source is turned off (step s103), and the process proceeds to step s104 to determine whether the ejection of the paper sheet is being executed. When the lighting of the paper sheet ejection is in the turned-on state (Yes in step s102), the process proceeds to step s104 to determine whether the ejection of the paper sheet is being executed.

According to the present embodiment, both of the function of illuminating the ejected paper sheet aid the function of notifying the state of the image formation can be implemented using one illuminator serving multiple functions, which leads to a reduction in cost. Further, the illumination is distinguished between the first notification and the second notification and controlled, whereby the operation state can be made easier to recognize.

Next, an example of a development of the configuration according to the present invention will be described. Note that descriptions of the configuration common to that in the first embodiment will be omitted.

An optional device such as a post-processing device for the paper sheet can be connected to the sheet ejector of the image forming apparatus. However, when the post-processing device is connected, the position of the ejection of the paper sheet changes, whereby the ejected paper sheet may not be appropriately illuminated.

In view of the above, in this embodiment, a mechanism for varying an optical axis is provided to change the illumination position according to the change in the device configuration. Changing the illumination position is an example of the illumination change.

Any means may be adopted as the means for varying the optical axis, and for example, a method in which the entire optical system is made movable using an actuator, or a method in which lighting of the LED provided in a different direction beforehand is switched can be used.

Further, in actual control, information associated with the ejection position corresponding to the type of the post-processing device may be prepared beforehand, the type of the connected device may be determined, and the illumination position may be changed according to the type of the post-processing device, for example.

The illumination position according to the existence or non-existence of the post-processing device will be described with reference to FIGS. 7A and 7B.

Figure 7A:
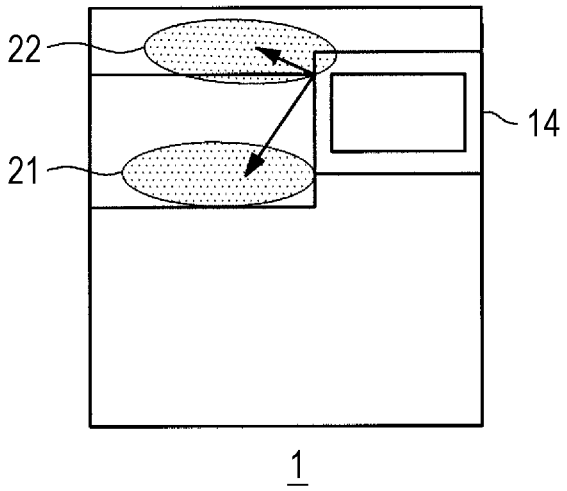
FIGS. 7A and 7B are diagrams illustrating an illumination range in a state where a post-processing device is not attached to an image forming apparatus and an illumination range in a state where the post-processing device is attached to the image forming apparatus according to one embodiment of the present invention.

FIG. 7A illustrates the image forming apparatus 1 in a state where the post-processing device is not attached, and the light from the light source in the illuminator illuminates the vicinity of the front surface of the document reader 13 of the image forming apparatus 1 and the vicinity of the undersurface of the sheet ejector 15 below the document reader 13.

Figure 7B:
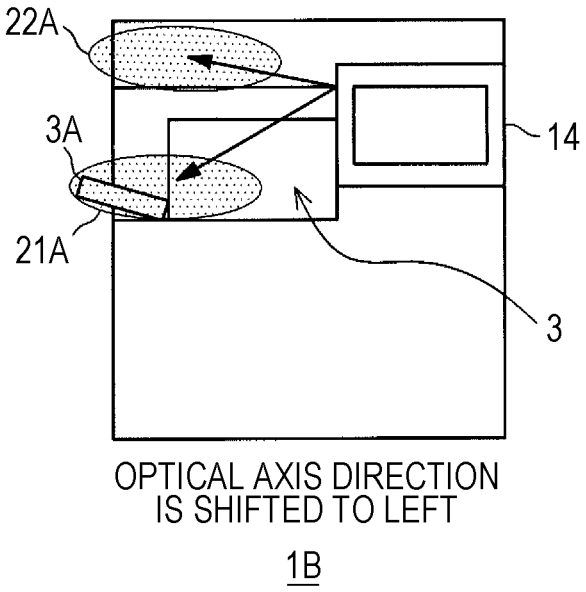

FIG. 7B illustrates an image forming apparatus 1B in a state where the post-processing device is attached thereto. Since the post-processing device is connected to this apparatus, the ejection destination of the paper sheet is shifted to the left side in the drawing as compared with the case where the post-processing device is not attached. In order to cope with this, the optical axis is shifted such that the light is emitted to the left side as compared with the case where the post-processing device is not attached, whereby an illumination area 211A overlaps a sheet ejector 3A of a post-processing device 3. Note that an illumination area 22A on the front side of the document reader 13 also illuminates the left side portion at the same time.

With this arrangement, it becomes possible to illuminate an appropriate position even when the configuration of the apparatus changes.

Although the illumination position is changed both in the first notification and the second notification depending on whether the post-processing device is connected in the example described above, it may be configured or controlled such that the illumination position is changed only in the second notification.

Note that, even when the post-processing device is attached, the means for varying the optical axis may not be used and the illumination of the sheet ejector may be turned off as long as the sheet ejector is not shadowed by the operation part due to the attachment of the post-processing device and the paper sheet is ejected to a position that can be visually confirmed.

Furthermore, the size and orientation of the paper sheet ejected from the image forming apparatus 1 are varied. Therefore, it is preferable to change the position and the range on the sheet ejector to be illuminated depending on the sheet size and orientation.

In view of the above, in the present embodiment, a mechanism for changing the illumination angle and the illumination range of the light source is provided in the illuminator, thereby changing the illumination position depending on the size and orientation of the paper sheet. Changing the illumination position and the illumination range is an example of the illumination change.

FIGS. 8A and 8B, and 9A and 9B illustrate an exemplary case where the position or the range of the illumination area is changed according to the size of the paper sheet S ejected from the apparatus body and the sheet orientation at the time of sheet ejection.

Figure 8A:
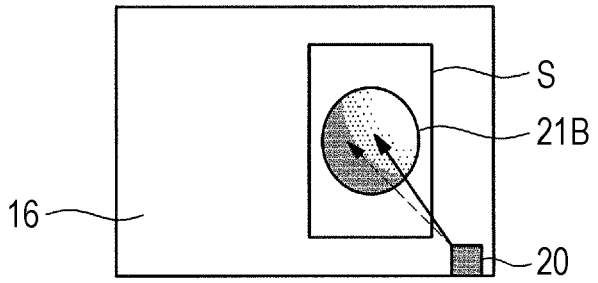
FIGS. 8A and 8B are diagrams illustrating an illumination area in the case where a sheet size is A4 and a sheet orientation is portrait and an illumination area in the case where the sheet size is A4 and the sheet orientation is landscape in an image forming apparatus according to one embodiment of the present invention.

FIG. 8A illustrates the illumination area in the case where the sheet size is A4 and the sheet orientation is portrait. Since an A4 paper sheet is ejected to a position close to the light source, the optical axis is directed to the right to illuminate light in such a manner that an illumination area 21B is positioned at the center of the paper sheet.

Figure 8B:
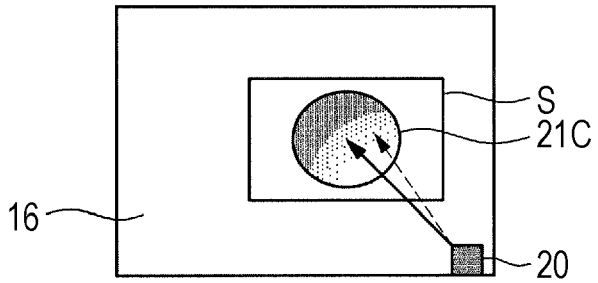

FIG. 8B illustrates a case where the sheet size is A4 and the sheet orientation is landscape. In the case where the sheet orientation is landscape, the center position of the paper sheet is shifted in the direction away from the light source (leftward in the drawing) as compared with the A4 portrait mode, whereby the direction of the optical axis is slightly shifted to the left side. As a result, an illumination area 21C is positioned in the vicinity of the center of the paper sheet, whereby the paper sheet can be easily visually recognized.

Figure 9A:
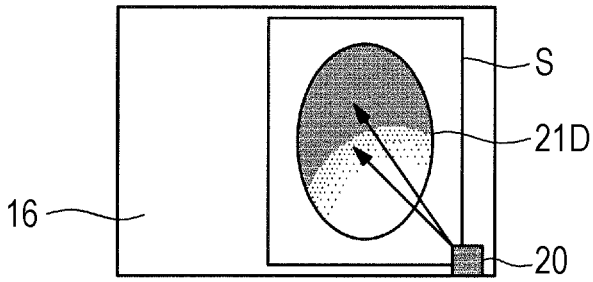
FIGS. 9A and 9B are diagrams illustrating an illumination area in the case where a sheet size is A3 and a sheet orientation is portrait and an illumination area in the case where the sheet size is A3 and the sheet orientation is landscape in an image forming apparatus according to one embodiment of the present invention.

FIG. 9A illustrates a case where the sheet size is A3 and the sheet orientation is portrait. In the case where the sheet size is A3, the illumination angle is changed to increase the illumination range in the longitudinal direction so that a range wider than that in the case of A4 size paper is illuminated. Accordingly, a wide area in the vicinity of the center of the paper sheet can be set as an illumination area 21D.

Figure 9B:
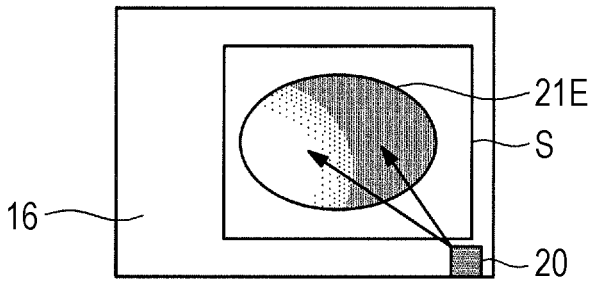

FIG. 9B illustrates a case where the sheet size is A3 and the sheet orientation is landscape. Since the center position shifts to the left as compared with the case of portrait and the sheet size is large, the illumination range is increased in the lateral direction. Accordingly, a wide area in the vicinity of the center of the paper sheet can be set as an illumination area 21E.

As described above, since the sheet ejection position varies depending on the sheet size and the sheet orientation, the manner of illumination of the light source is changed according to the size of the ejected sheet and the sheet orientation at the time of sheet ejection, whereby constant illumination for easy recognition can be achieved.

Figure 10:
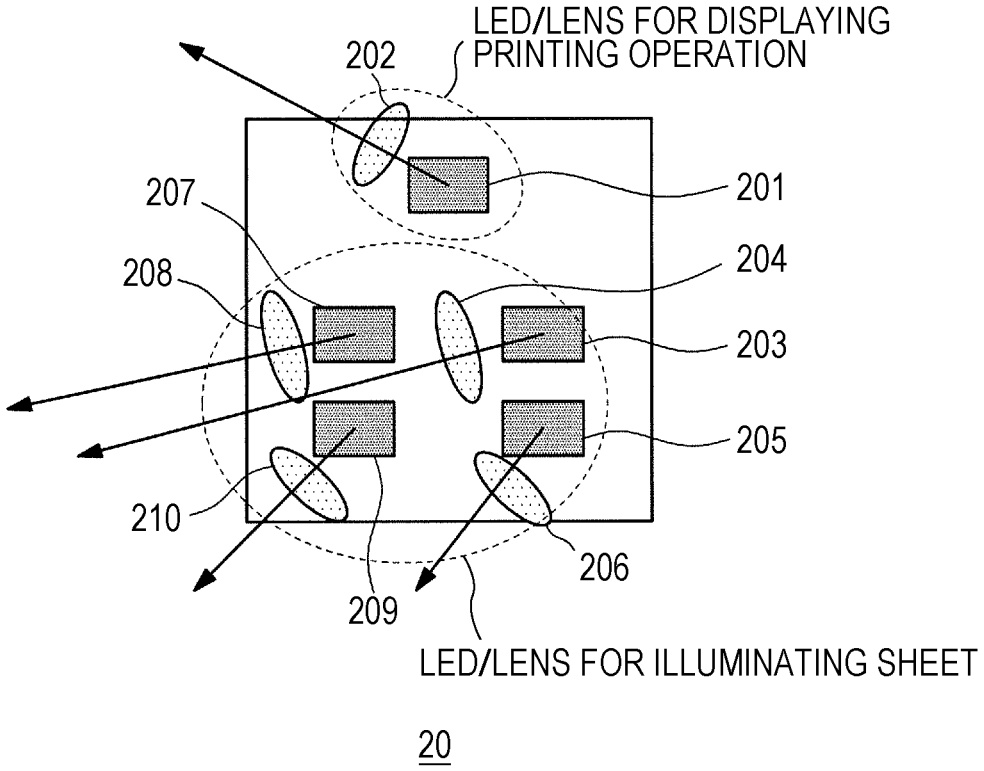
FIG. 10 is a diagram illustrating an exemplary configuration of a light source unit of an image forming apparatus according to one embodiment of the present invention.

FIG. 10 illustrates an exemplary configuration of a light source unit in the illuminator 20. In this example, the illuminator 20 includes one light source unit in which a plurality of LEDs and optical lenses are disposed.

Since illumination for notifying the printing operation only needs to be performed with a fixed orientation/illumination angle regardless of the sheet size, it is implemented by one set of the LED and the lens. In the example of FIG. 10, an LED 201 and a lens 202 serve as a light source for displaying the printing operation. In this example, the light source for illuminating the ejected paper sheet includes a total of four sets of LEDs and lenses for A3 and A4, and portrait and landscape. Note that a common illumination controller can be used in those configurations.

In this example, LEDs 203, 205, 207, and 209 and lenses 204, 206, 208, and 210 correspond to the light source and the lens for paper sheet illumination.

For example, the LED 205 and the lens 206 are used in the A4 portrait mode, and the LED 209 and the lens 210 are used in the A4 landscape mode. The LED 203 and the lens 204, and the LED 205 and the lens 206 are used in the A3 portrait mode, and the LED 207 and the lens 208, and the LED 209 and the lens 210 are used in the A3 landscape mode.

Note that the number and arrangement of LEDs and lenses are not limited to the example of FIG. 10, and a desired configuration can be adopted.

In addition, instead of switching the LED to be turned on, a mirror, a prism, and the like may be provided in the illuminator 20 to change the optical axis using those components.

Figure 11:
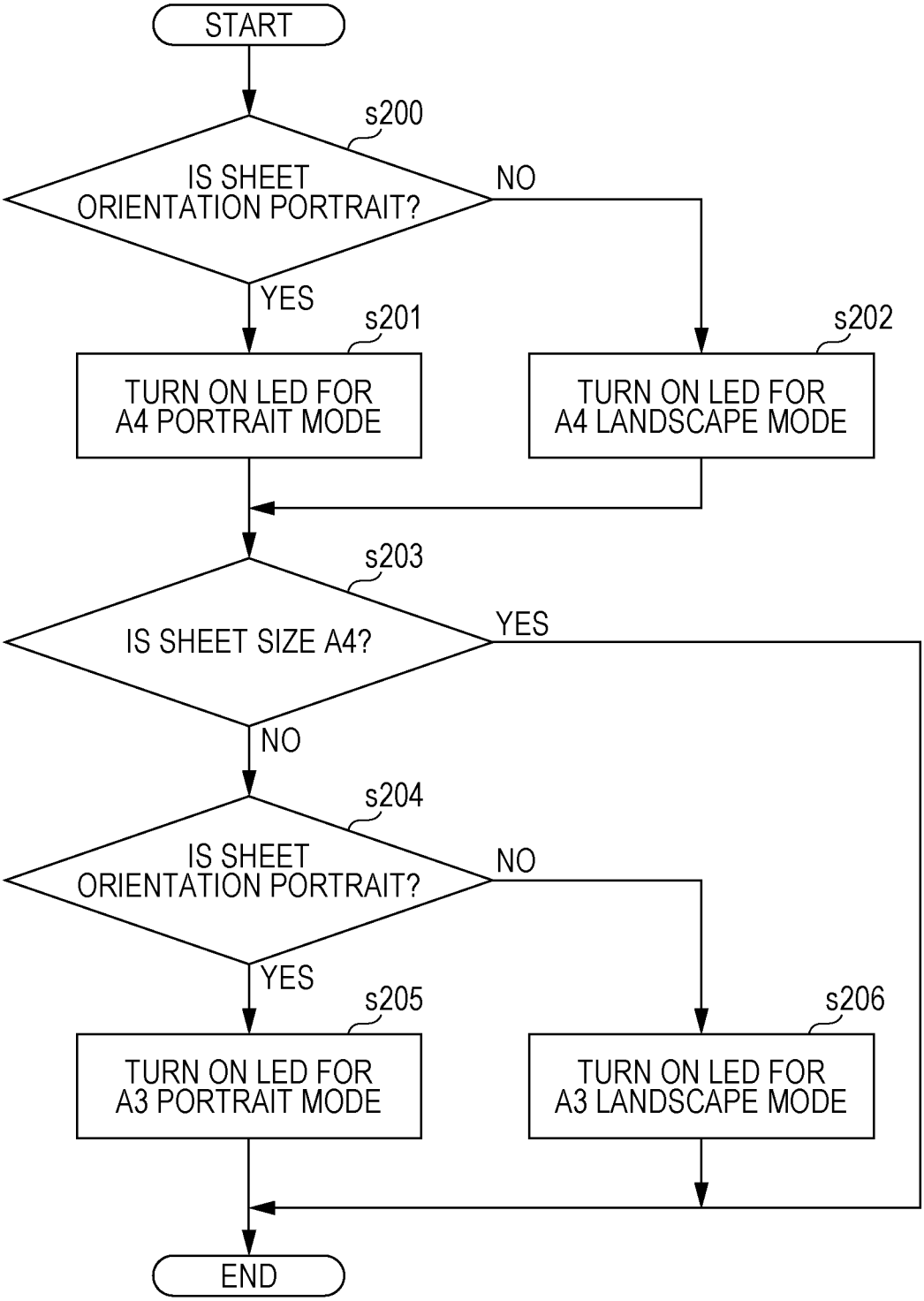
FIG. 11 is a flowchart illustrating a procedure of switching a light source to be used according to a size and orientation of a paper sheet in an image forming apparatus according to one embodiment of the present invention.

Next, the procedure for changing the illumination position according to the sheet size (A3 and A4) and the sheet orientation (portrait and landscape) will be described with reference to the flowchart of FIG. 11. The following procedure is executed by the control of the controller 100.

First, it is determined whether the sheet orientation is portrait (step s200). When the sheet orientation is portrait (Yes in step s200), the LED for the A4 portrait mode is turned on (step s201). In the example of FIG. 10, the LED 205 is turned on. When the paper select is not portrait, that is, when the paper sheet is landscape (No in step s201), the LED for the A4 landscape mode is turned on (step s202). In the example of FIG. 10, the LED 209 is turned on.

Upon completion of step s201 or step s202, it is determined whether the paper sheet to be ejected is A4 (step s203).

When the size is A4 (Yes in step s203), the light source has already been turned on in an appropriate state, thereby terminating the process. When the size is not A4 (No in step s203), that is, when the sleet size is A3, it is determined whether the sheet orientation is portrait (step s204). When the sheet orientation is portrait (Yes in step s204), the LED for the A3 portrait mode is additionally turned on (step s205). When the sheet orientation is landscape (No in step s204), the LED for the A3 landscape mode is additionally turned on (Yes in step s206). Upon completion of step s205 or step s206, the procedure is terminated.

According to the present embodiment, the illumination position is changed according to the size and orientation of the paper sheet, whereby the ejected paper sheet can be easily confirmed.

Although embodiments of the present invention have been described and illustrated in detail, the disclosed embodiments are made for purposes of illustration and example only and not limitation. The scope of the present invention should be interpreted by terms of the appended claims. Appropriate modifications to the embodiments described above may be made without departing from the scope of the present invention.

What is claimed is:

1. An image forming apparatus, comprising:

an image former that forms an image on a recording medium with an image forming operation;

an ejector to which a recording medium is ejected;

a notifier that visually notifies a predetermined operation state of the image forming apparatus using a light source; and a hardware processor that controls the image forming operation of the image former, an ejecting operation of the ejector, and a notifying operation of the notifier, wherein:

the hardware processor is configured to:

operate the notifier in a first mode to indicate that the image forming operation is in progress, the notifier being operated in the first mode only at a time when the forming operation is executed, operate the notifier in a second mode to indicate that the image formation is complete and the recording medium having been subject to the image formation is ejected, wherein the notifier is operated in the second mode only after the recording medium having been subject to the image formation has been ejected; and the hardware processor is further configured to control the light source of the notifier when operating in the second mode to illuminate the sheet elector where the recording medium is elected by changing one of or both of an illumination range of the light source and an optical axis angle of the light source depending on a size and orientation of the ejected recording medium in order to ensure illumination of the ejected recording medium.

2. The image forming apparatus according to claim 1, wherein the notifier includes a light source that emits light to an undersurface of the ejector to which the recording medium is ejected and to a reflective surface that is provided on a longitudinal surface of an apparatus body with respect to the undersurface and reflects light to a front side.

3. The image forming apparatus according to claim 1, wherein the notifier emits light to a same area at a time when the first notification function is executed and at a time when the second notification function is executed, and switches the first notification function and the second notification function while illumination of the light source is distinguished according to switching to perform control.

4. The image forming apparatus according to claim 1, wherein the notifier includes an optical axis moving part that changes a direction in which light is illuminated, and the hardware processor is configured to change an optical axis to change an illumination position using the optical axis moving part.

5. The image forming apparatus according to claim 1, wherein the hardware processor is configured to control illumination of the notifier according to existence or non-existence of a post-processing device to be attached to the ejector.

6. The image forming apparatus according to claim 5, wherein the hardware processor is configured to control only the illumination of the notifier in the second notification function according to the existence or non-existence of the post-processing device.

7. The image forming apparatus according to claim 1, wherein the hardware processor is configured to independently control illumination of the notifier according to execution of the first notification function and execution of the second notification function.

8. The image forming apparatus according to claim 3, wherein illumination of the notifier is controlled on the basis of at least one of lighting of the light source, change of an optical axis, and change of an illumination range in the notifier.

9. The image forming apparatus according to claim 1, wherein the notifier includes a plurality of light sources, and the hardware processor is configured to change an illumination position in the notifier by switching the plurality of light sources.

10. The image forming apparatus according to claim 1, further comprising:

an operation part capable of displaying information and inputting operation, wherein the notifier includes a light source provided on a back side of the operation part.

11. The image forming apparatus according to claim 10, further comprising:

a fixed stay that is positioned on the back side of the operation part and movably holds the operation part, wherein the light source is attached to the fixed stay.

12. The image forming apparatus according to claim 1, wherein the hardware processor is configured to control one of or both of the illumination range and the optical axis angle according to a state of the image forming apparatus or a job type.

13. The image forming apparatus according to claim 12, wherein the state of the image forming apparatus is existence or non-existence of a post-processing device attached to the ejector.

14. The image forming apparatus according to claim 12, wherein the job type is a size and/or orientation of a recording medium on which an image is formed and to be ejected to the ejector.

15. The image forming apparatus according to claim 1, wherein the hardware processor is configured to change one of or both of the illumination range illuminated by the light source and the optical axis angle of light according to the orientation of the recording medium.

16. The image forming apparatus according to claim 1, wherein the hardware processor is configured to change one of or both of the illumination range illuminated by the light source and the optical axis angle of light according to the size of the recording medium.

17. The image forming apparatus according to claim 1, wherein the hardware processor is further configured to control the light source of the notifier when operating in the second mode to illuminate the recording medium on the sheet ejector where the recording medium is ejected.

* * * * *